US006041715A

United States Patent [19]

Jarke et al.

[11] Patent Number: 6,041,715

[45] Date of Patent: Mar. 28, 2000

[54] ACTIVITY SURFACE AND REST APPARATUS

[76] Inventors: Joseph M. Jarke; Jan T. Jarke, both of 6108 Dedham Ln., Austin, Tex. 78739-1536

[21] Appl. No.: 09/215,770

[22] Filed: Dec. 18, 1998

Related U.S. Application Data

[63] Continuation-in-part of application No. 08/929,077, Sep. 15, 1997, abandoned.

[51] Int. Cl.[7] ..... A47B 37/00

[52] U.S. Cl. ..... 108/43; 5/639

[58] Field of Search ..... 108/13, 43, 44, 108/93, 97; 248/444; 5/639, 636

[56] References Cited

U.S. PATENT DOCUMENTS

| | | | |
|---|---|---|---|
| D. 52,678 | 11/1918 | Scheibe . | |
| D. 204,784 | 5/1966 | O'Neil . | |
| D. 342,634 | 12/1993 | Barlow-lawson . | |
| D. 342,806 | 12/1993 | Jones et al. . | |
| D. 342,873 | 1/1994 | Dannenberg . | |
| D. 366,780 | 2/1996 | Brooks . | |
| D. 382,727 | 8/1997 | Kresge et al. . | |
| 4,235,472 | 11/1980 | Sparks et al. | 108/43 |
| 4,788,916 | 12/1988 | Saxton . | |
| 4,926,758 | 5/1990 | Lilly et al. | 108/43 |
| 5,090,334 | 2/1992 | Sutto . | |
| 5,355,811 | 10/1994 | Brewer . | |

FOREIGN PATENT DOCUMENTS

| | | | |
|---|---|---|---|
| 302676 | 11/1932 | Italy | 108/43 |

*Primary Examiner*—Peter M. Cuomo
*Assistant Examiner*—Gerald A. Anderson
*Attorney, Agent, or Firm*—Akin, Gump. Strauss. Hauer & Feld, L.L.P.

[57] ABSTRACT

A portable activity surface and pillow. The activity surface and pillow may be utilized in various configurations whereby either side of the activity surface may be utilized or the pillow may be used independently. A removable insert provides an alternate surface for one side of the activity surface.

7 Claims, 3 Drawing Sheets

ACTIVITY SURFACE AND REST APPARATUS

CONTINUING DATA

This application is a continuation-in-part of U.S. patent application Ser. No. 08/929,077 filed Sep. 15, 1997, now abandon, entitled MULTIPURPOSE LAP DESK APPARATUS, the disclosure of which is hereby incorporated by reference.

BACKGROUND OF THE INVENTION

The present invention relates to a portable, multipurpose activity surface and rest apparatus. More particularly, the present invention relates to a combination multipurpose activity surface and multipurpose pillow member.

It is frequently necessary or desirable to have a portable tray or activity surface, particularly when traveling or when sitting on a couch or recliner, or sitting up in bed. Prior efforts to address this need include devices in which a pillow like support member is securely affixed to a rigid surface which may be used for working, eating, or other activities, such as playing cards. However, in such devices only one side of the activity surface may be utilized and, if the device is used as a "pillow," it is generally not flexible or comfortable due to the secure attachment of the rigid member thereto. Similarly, U.S. Pat. No. 4,788,916 issued to Saxton discloses a cushion pouch tray that is specifically designed so that only one side of the rigid tray member may be utilized when attached to the pouch. In particular, U.S. Pat. No. 4,788,916 is particularly directed to a serving tray in which the tray may be removed from the accompanying pouch for cleaning purposes.

SUMMARY OF THE INVENTION

Accordingly, the present invention provides a combination multipurpose activity surface and multipurpose pillow member that is portable and that may be assembled and utilized in various configurations. The apparatus is specifically designed to receive an insert to vary the surface on one side of the activity member.

The combination activity and rest apparatus of the present invention includes an activity member having first and second usable sides and a pillow member which may be releasably attached to the activity member. The activity member may be releasably attached to the pillow member in a first configuration allowing the user to access and use the first side of the activity member or in a second configuration allowing the user to access and use the second side of the activity member. A removable insert may be utilized to provide an alternate surface on one side of the activity member. The activity member portion of the apparatus may thereby provide a plurality of different working or activity surfaces which may be supported by the pillow member. Alternatively, the pillow member may be detached from the activity member and utilized independently for resting.

DETAILED DESCRIPTION OF THE PREFERRED EMBODIMENT

Figure 1:
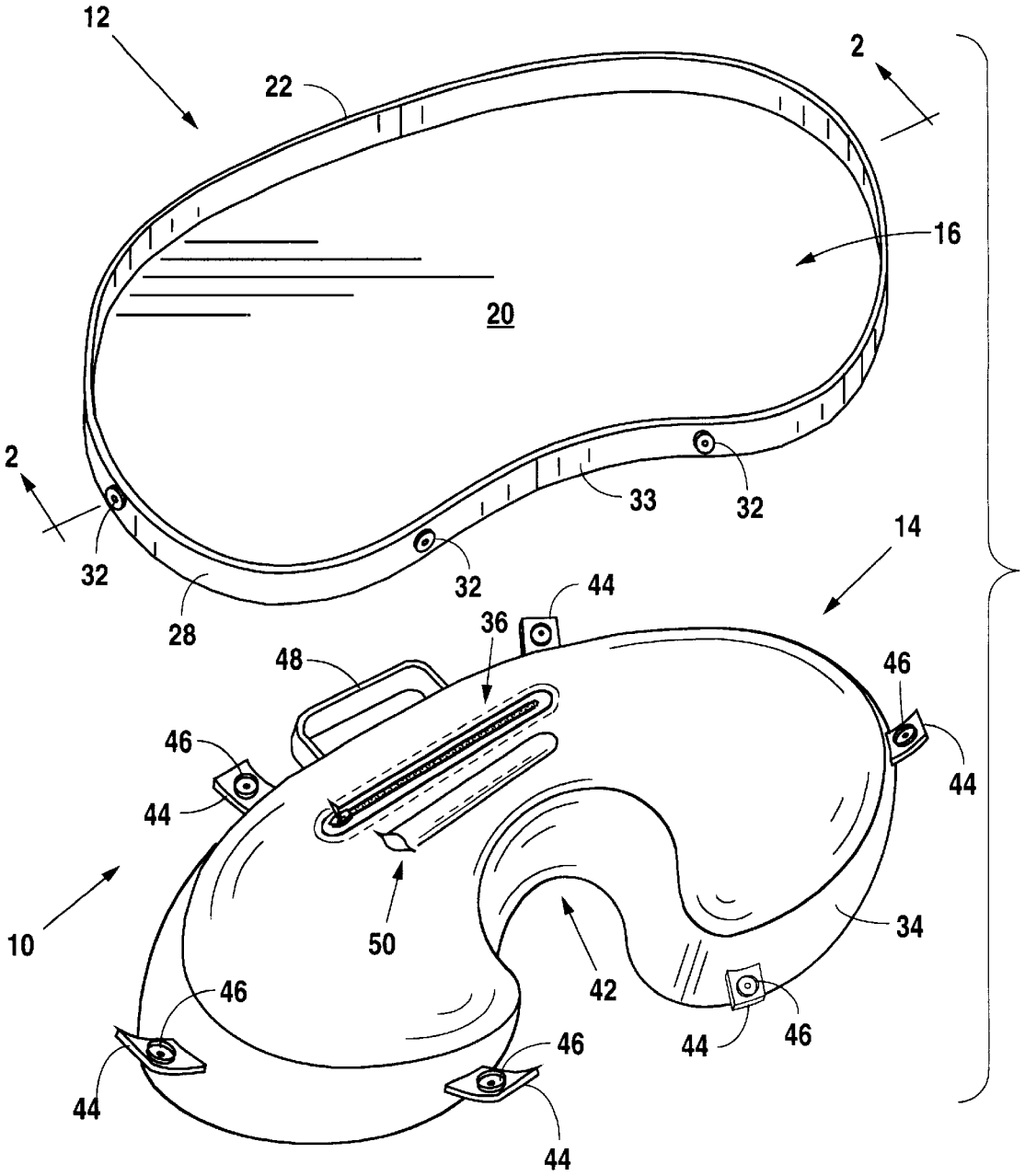
FIG. 1 is an exploded view of the activity surface and rest apparatus of the present invention.
Figure 2:
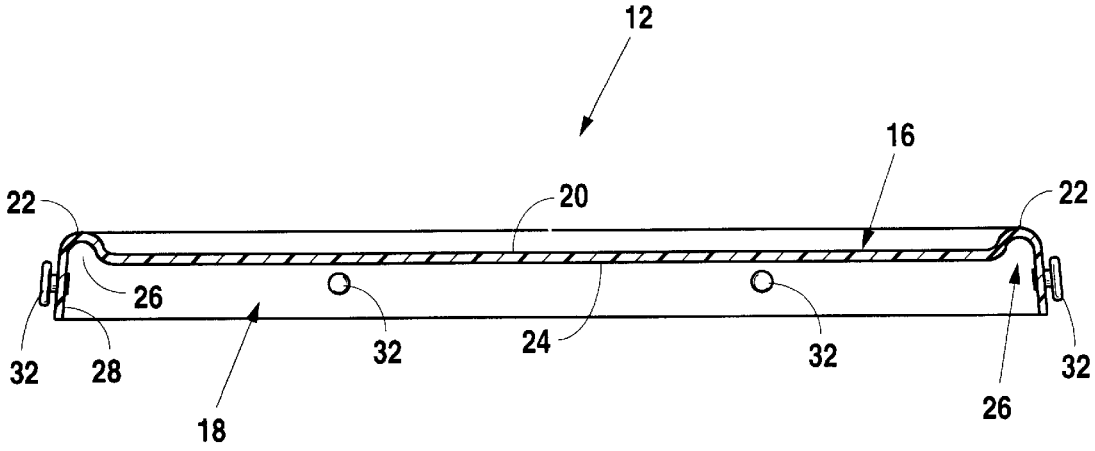
FIG. 2 is a cross-sectional view of the activity surface of the present invention taken along section lines 2—2 of FIG. 1.
Figure 3:
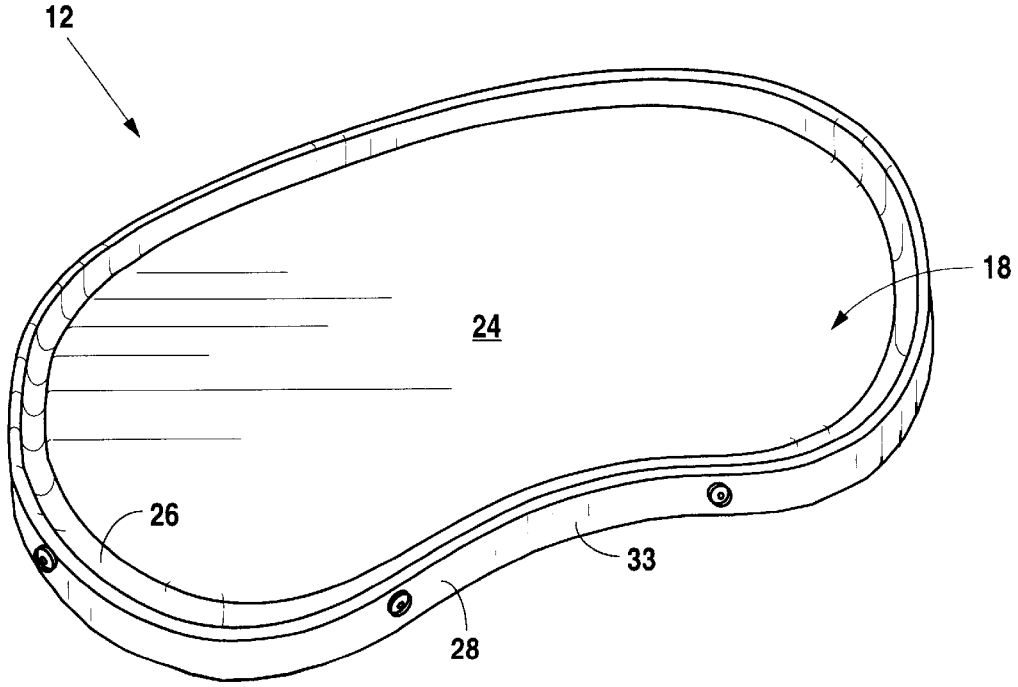
FIG. 3 is a perspective view of an opposite side of the activity surface of the present invention.

Referring to FIGS. 1–3, the preferred embodiment of the activity surface and rest apparatus of the present invention is identified by the number 10. The apparatus 10 comprises an activity member 12 and a pillow member 14. Activity member 12 comprises a generally rigid member having a first side 16 and a second side 18. First side 16 comprises a generally planar surface 20 and a lip 22 about the periphery thereof. Second side 18 comprises a generally planar surface 24, a groove 26 about the periphery of surface 24 and a sidewall 28. The male or female portion of a plurality of snap assemblies 30 are identified by the number 32 and appropriately secured to sidewall 28. Member 12 is preferably ergonomically shaped in an elliptical or quasi-elliptical design having an arcuate or curved indentation 33 in the periphery thereof defining the portion of the member 12 intended to be adjacent to the user of the apparatus 10.

Figure 4:
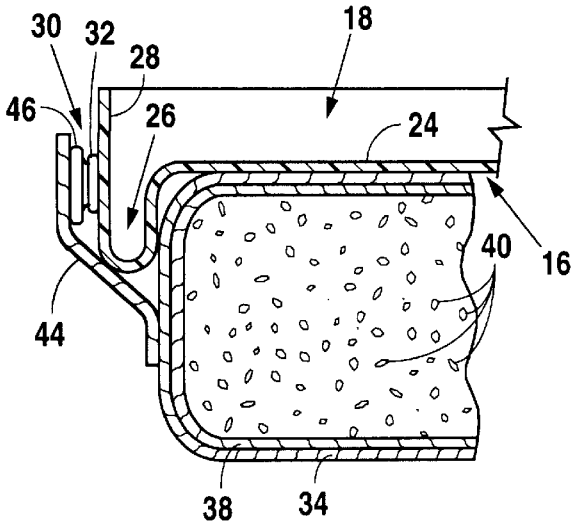
FIG. 4 is a cross-sectional, cut away, view illustrating attachment of the pillow member to the activity surface in the present invention.

Referring to FIG. 1 and FIG. 4, the pillow member 14 comprises an outer fabric material 34 having a zipper 36 sown therein to permit access to a cavity within material 34. Received within the cavity within fabric 34 is a pouch member 38 having granular material 40 therein. Fabric pouch 38 may also be provided with a zipper sown therein (not shown) for permitting insertion and removal of granular material 40. Material 40 is preferably buckwheat hulls, but may also comprise foam, feathers or other material commonly used in flexible or limp pillows or cushions. Pillow 14 provides a stable support to member 12 atop the lap of a user and a comfortable headrest when the user desires to rest.

Referring again to FIG. 1, the pillow member 14 is preferably shaped so as to provide a curved recess 42 therein so that the pillow member 14 may be placed about the neck of a user thereof. Further, a plurality of belt webbing pieces 44 are sewn to fabric material 34. A plurality of mating male or female snap connections 46 are appropriately secured to webbing strips 44. Webbing 44 and connections 46 are sized and positioned to allow removable attachment to complimentary snap portions 32 regardless of the side of member 12 to which pillow 14 is attached. Pillow member 14 may be further provided with a carrying handle 48 formed of webbing fabric sown to outer material 34. A pocket 50 for receiving a pen, pencil, marker or other writing instrument may also be formed in material 34.

Referring to FIG. 4, the releasable attachment of pillow member 14 to activity member 12 is illustrated with pillow member 14 attached to side 16, thereby permitting access and usage of side 18. It is to be understood, however, that snap connector assemblies 30 may also be utilized to releasably secure pillow member 14 to side 18 to permit access to and usage of side 16. Further, when it is desired to merely use pillow member 14, pillow member 14 may be removed from activity member 12 by detaching the snap connectors 30. It is to be appreciated, however, that other appropriate releasable attachment devices, such as zippers, buttons, or hook and loop fastener means may be utilized to permit releasable attachment of pillow member 14 to either side of activity member 12.

Figure 5:
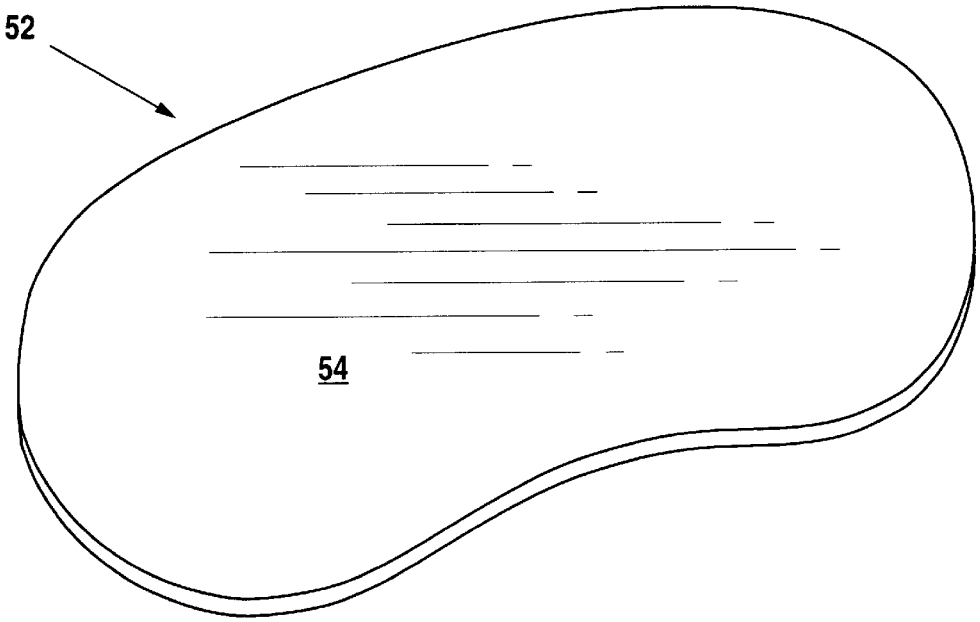
FIG. 5 is a perspective view of an insert member that may be utilized in the present invention.
Figure 6:
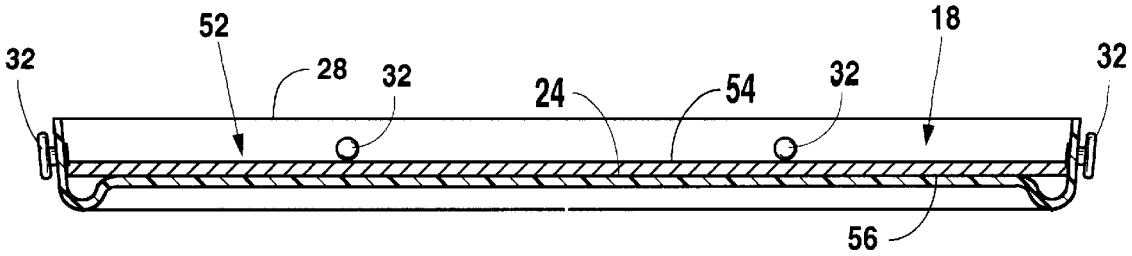
FIG. 6 is a cross-sectional view of the activity surface illustrating insertion of the insert member in the present invention.

Referring to FIG. 5 and FIG. 6, a removable insert member is identified by the number 52. Insert member 52 has a first side or surface 54 and a second side or surface 56. Member 52 is shaped so as to be capable of being received within a recess defined by sidewall 28 on side 18 of member 12. It is to be understood that either side 54 or 56 may be placed face down on surface 24 so that the opposite side of member 52 is accessible to the user. Further, insert member 52 may be removably secured to side 18 in a press fit. Alternatively, member 52 may be permanently secured to a surface 24 such as by glue or other bonding material. It is to be understood that insert 52 may be a unitary material, such as dry erase board which may be marked upon by a conventional dry erase marker, or compressible material commonly used for computer mouse pads. Alternatively, member 52 may be designed so that side 54 is magnetized and side 56 has a game design thereon, such as a checkerboard or chess game design.

It is to be understood that the activity surface and rest apparatus 10 may be utilized in various combinations or configurations. In a first configuration, pillow member 14 is releasably attached to activity surface 12 on side 18 by snap assemblies 30. In this configuration, the apparatus 10 may be placed on the lap of the user so that pillow member 14 conforms thereto and supports the activity surface 12. In this configuration, the user has access to side 16 for use as a desktop, writing surface, dining tray, or for engaging in other activities, such as playing cards. Further, surface 20 may be rough, smooth or otherwise textured.

In a second configuration, pillow member 14 is releasably secured to side 16 to permit access to and use of side 18, as illustrated in FIG. 4. As in the first configuration described hereinabove, the releasable securement of the pillow member 14 and activity surface 12 is accomplished by the snap assemblies 30. In the second configuration, the periphery groove 26 provides a recess for receiving objects such as pen, pencils or highlighters when using the side 18 as a desk or for collecting spilled liquids when side 18 is used as a dining tray. Further, surface 24 may be rough, smooth or otherwise textured, and preferably having a texture different from surface 20.

In a third configuration, the insert 52 is received on side 18 adjacent to surface 24 so that the user has access to and use of surface 54 or surface 56, depending upon the surface facing upward (away from surface 24). In this third configuration, the insert 52 may be compressible material such as commonly used for computer mouse pads, or dry erase board material, or it may have a game board design (such as chess or checkers squares or other design) on either or both sides thereof. Additionally, either or both sides of insert 52 may be magnetized for receiving magnetic game pieces.

In yet another configuration, the present invention may be utilized as a pillow with the pillow member 14 attached to or detached from activity surface 12. When a user of apparatus 10 decides to place the pillow member 14 around his or her neck, the pillow member 14 would normally be disconnected from the activity surface 12. When attached, pillow member 14 is attached directly to activity member 12 as described hereinabove.

It is to be understood that one of the primary advantages of the present invention is an apparatus 10 wherein the activity member 12 and pillow member 14 may be used in an attached configuration or independently. Likewise, the member 12 preferably comprises alternate usable sides providing different features, textures, compositions or designs for different applications. This may be accomplished by altering the composition of the surfaces 20 and 24 or by using one or more different insert members 52. It is also to be understood that the apparatus 10 may be configured as a kit comprising activity member 12, pillow member 14 and one or more insert members 52. Additionally, chess, checkers or other game pieces, and an erasable marker may also be included in the kit.

The activity surface and rest apparatus 10 is readily portable and may also be configured to be carried by means of handle 48. In this configuration, the pillow member 14 need merely be secured to the activity surface 12 as described hereinabove. If insert 52 is utilized with or intended to be carried with the apparatus 10, it may be placed on side 18 and the pillow member 14 thereafter secured to activity surface 12 a top insert 52 so that insert 52 is intermediate to pillow member 14 and surface 24 and secured therebetween.

It is to be understood that activity member 12 may be formed of injection molded PVC plastic. In addition, an indentation or hole (not shown) may be formed in surfaces 20 or 24 for holding a cup or other drink receptacle. Likewise, elongated indentations (not shown) may be formed in surface 20 or 24 for receiving items such as pencils or pens. Finally, it is to be understood that clip-on items, such as portable clip-on lights, can be affixed to the periphery of member 12.

While the activity surface and rest apparatus of the present invention has been described in connection with the preferred embodiment, it is not intended to limit the invention of the particular form set forth, but it is intended to cover such alternatives, modifications and equivalents as may be included within the scope and spirit of the invention as defined by the appended claims.

I claim:

1. A combination activity and rest apparatus, comprising:

an activity member comprising first and second usable sides;

a resilient pillow member having a recess therein for positioning said pillow about a user's neck; and means for releasable attachment of said activity member to said pillow member, said releasable attachment in a first configuration whereby said first side of said activity member may be used and said pillow member supports said activity member and conforms to a surface upon which it mag rest, and releasable attachment in a second configuration whereby said second side of said activity member may be used and said pillow member supports said activity member and conforms to a surface upon which it may rest.

2. A combination activity and rest apparatus, as recited in claim 1 wherein said pillow member comprises a headrest which may be used in said first or second configuration or when released from said activity member.

3. A combination activity and rest apparatus, as recited in claim 1, wherein said first side comprises a first material defining a first surface and said second side comprises a second material defining a second surface.

4. A combination activity and rest apparatus, as recited in claim 3, wherein said first material is compressible.

5. A combination activity and rest apparatus, comprising:

an activity member comprising first and second usable sides;

an insert member for attachment to said activity member on one of said first and second usable sides;

a resilient pillow member having a recess therein for positioning said pillow about a user's neck; and means for releasable attachment of said activity member to said pillow member, said releasable attachment in a first configuration whereby said first side of said activity member may be used and said pillow member supports said activity member and conforms to a surface upon which it may rest, and releasable attachment in a second configuration whereby said second side of said activity member may be used and said pillow member supports said activity member and conforms to a surface upon which it may rest.

6. A combination activity and rest apparatus, as recited in claim 5, wherein said insert member may be removably attached to said activity member.

7. A combination activity and rest apparatus, comprising:

an activity member comprising first and second usable sides;

a resilient pillow member shaped to permit positioning of said pillow member about a user's neck; and connection members on said activity member and said pillow member for releasable attachment of said activity member to said pillow member, said releasable attachment in a first configuration whereby said first side of said activity member may be used and said pillow member supports said activity member and conforms to a surface upon which it may rest, and releasable attachment in a second configuration whereby said second side of said activity member may be used and said pillow member supports said activity member and conforms to a surface upon which it may rest.

* * * * *